US009476661B2

(12) United States Patent
Troy et al.

(10) Patent No.: US 9,476,661 B2
(45) Date of Patent: Oct. 25, 2016

(54) FIREARM SUPPRESSOR

(76) Inventors: Stephen P. Troy, Lee, MA (US); David A. Hewes, Chesterfield, MA (US)

( * ) Notice: Subject to any disclaimer, the term of this patent is extended or adjusted under 35 U.S.C. 154(b) by 194 days.

(21) Appl. No.: 13/349,551

(22) Filed: Jan. 12, 2012

(65) Prior Publication Data

US 2012/0180624 A1 Jul. 19, 2012

Related U.S. Application Data

(60) Provisional application No. 61/432,709, filed on Jan. 14, 2011.

(51) Int. Cl.
*F41A 21/30* (2006.01)

(52) U.S. Cl.
CPC ..... *F41A 21/30* (2013.01)

(58) Field of Classification Search
CPC ..... F41A 21/26–21/36
USPC ..... 89/14.4; 181/223
See application file for complete search history.

(56) References Cited

U.S. PATENT DOCUMENTS

| | | | | | |
|---|---|---|---|---|---|
| 1,854,974 | A * | 4/1932 | Bernat | F41A 21/30 | 181/223 |
| 4,510,843 | A * | 4/1985 | Rabatin | 89/14.4 | |
| 4,576,083 | A * | 3/1986 | Seberger, Jr. | 89/14.4 | |
| 4,907,488 | A * | 3/1990 | Seberger | 89/14.4 | |
| 4,939,977 | A * | 7/1990 | Stroup | 89/14.4 | |
| 5,679,916 | A * | 10/1997 | Weichert | 89/14.4 | |
| 6,339,992 | B1 * | 1/2002 | Watson | 102/312 | |
| 6,374,718 | B1 * | 4/2002 | Rescigno et al. | 89/14.4 | |
| 6,425,310 | B1 * | 7/2002 | Champion | F41A 21/36 | 89/14.3 |
| 6,575,074 | B1 * | 6/2003 | Gaddini | 89/14.4 | |
| 7,832,323 | B1 * | 11/2010 | Davies | 89/14.4 | |
| 7,987,944 | B1 * | 8/2011 | Brittingham et al. | 181/223 | |
| 8,087,337 | B1 * | 1/2012 | Cary | F41A 21/30 | 89/14.3 |
| 8,516,941 | B1 * | 8/2013 | Oliver | F41A 21/30 | 181/223 |
| 2011/0056111 | A1 * | 3/2011 | Brittingham | 42/90 | |
| 2012/0048100 | A1 * | 3/2012 | Davies | 89/14.2 | |

* cited by examiner

*Primary Examiner* — Troy Chambers
*Assistant Examiner* — Benjamin Gomberg
(74) *Attorney, Agent, or Firm* — Robert A. Parsons; Michael W. Goltry; Parsons & Goltry

(57) ABSTRACT

A suppressor for reducing muzzle blasts in firearms includes mounting apparatus with a rear end designed to mate with a firearm barrel. A blast cap includes aligning and joining features mating the blast cap with the mounting apparatus. A plurality of baffles each includes aligning and joining features mating one baffle with the blast cap and the remaining baffles to each other. Each baffle includes a plate having gas ports therethrough positioned within a cylindrically shaped sidewall. The gas ports are positioned intermediate a central aperture and an outer edge of the plate. An end cap includes aligning and joining features mating the end cap with the adjacent baffle. The mounting apparatus, the blast cap, the plurality of baffles, and the end cap are affixed together using the aligning and joining features to form a suppressor and each includes a central aperture longitudinally aligned with the firearm barrel.

20 Claims, 5 Drawing Sheets

FIREARM SUPPRESSOR

CROSS-REFERENCE TO RELATED APPLICATIONS

This application claims the benefit of U.S. Provisional Application No. 61/432,709 filed 14 Jan. 2011.

FIELD OF THE INVENTION

This invention relates to firearms.

More particularly, the present invention relates to suppressors for reducing muzzle blasts in firearms.

BACKGROUND OF THE INVENTION

It is well known in the field of firearms to modify a barrel to compensate for various effects of firing a projectile using propellant gasses generated from the combustion of a propellant. Many common elements are provided in these devices. These elements are typically held within a shell, also called a can, which contains and aligns the respective elements. While effective, a shell results in extra weight which can adversely impact firing the firearm, and can also complicate the fabrication process thereby increasing the cost of the device.

It would be highly advantageous, therefore, to remedy the foregoing and other deficiencies inherent in the prior art.

Accordingly, it is an object of the present invention to provide a new and improved suppressor for reducing the muzzle blast in a firearm.

It is a further object of the present invention to provide a new and improved suppressor that can be relatively easily manufactured.

It is a further object of the present invention to provide a new and improved suppressor that can be modified to suppress muzzle blasts for a variety of different muzzle blast intensities.

It is a further object of the present invention to provide a new and improved suppressor that can be conveniently produced for and mounted on virtually any firearm.

SUMMARY OF THE INVENTION

Briefly, to achieve the desired objects and aspects of the instant invention in accordance with a preferred embodiment, a suppressor for reducing muzzle blasts in firearms is provided. The suppressor includes mounting apparatus with a rear end designed to mate with a firearm barrel and a front end. A blast cap has a rear end and a front end and defining a central aperture extending therethrough. The blast cap includes in conjunction with the mounting apparatus, aligning and joining features mating the rear end of the blast cap with the front end of the mounting apparatus. A plurality of baffles each having a rear end and a front end and each baffle defines a central aperture extending therethrough. Each baffle further includes aligning and joining features in conjunction with one of an adjacent baffle and the blast cap mating the rear end of the baffle with the front end of the one of the adjacent baffle and the blast cap. Each baffle includes a plate positioned within a cylindrically shaped sidewall, the plate of each baffle having a plurality of gas ports defined therethrough. The gas ports are spaced about the central aperture and positioned intermediate the central aperture and an outer edge of the plate. An end cap has a rear end and a front end and defines a central aperture extending therethrough. The end cap includes in conjunction with an adjacent baffle aligning and joining features mating the rear end of the end cap with the front end of the adjacent baffle. The mounting apparatus, the blast cap, the plurality of baffles, and the end cap are affixed together using the aligning and joining features to form a suppressor with the central apertures longitudinally aligned with the firearm barrel.

Desired objects and aspects of the instant invention are further achieved in accordance with another embodiment of a suppressor for reducing muzzle blasts in firearms that includes mounting apparatus including a rear mount assembly configured to engage the barrel of a firearm proximate a muzzle thereof, a front mounting block partially enclosing the rear mount assembly to prevent gasses from escaping therearound, and a blast shield abutting the front mounting block and forming a blast chamber at the muzzle of the firearm barrel. A blast cap includes a convex plate with a parametric edge defining a front end and a cylindrical sidewall extending generally perpendicularly from the parametric edge of the convex plate and terminating in a rear end. The blast cap defines a central aperture extending through the convex plate and includes in conjunction with the mounting apparatus aligning and joining features mating the rear end of the blast cap with the front end of the mounting apparatus. A plurality of baffles are included with each baffle of the plurality of baffles including a concave plate with a parametric edge defining a front end and a cylindrically shaped sidewall extending rearwardly generally perpendicularly from the parametric edge of the concave plate and terminating in a rear end. Each baffle further defines a central aperture extending through the concave plate and further includes aligning and joining features in conjunction with one of an adjacent baffle and the blast cap mating the rear end of the baffle with the front end of the one of the adjacent baffle and the blast cap. The concave plate of each baffle has a plurality of gas ports defined therethrough, the gas ports being spaced about the central aperture and positioned intermediate the central aperture and an outer edge of the plate. An end cap includes a convex plate with a parametric edge defining a front end and a cylindrical sidewall extending generally perpendicularly from the parametric edge of the convex plate and terminating in a rear end. The end cap defines a central aperture extending through the convex plate and includes in conjunction with an adjacent baffle aligning and joining features mating the rear end of the end cap with the front end of the adjacent baffle. The mounting apparatus, the blast cap, the plurality of baffles, and the end cap are affixed together using the aligning and joining features to form a suppressor with the central apertures longitudinally aligned with the firearm barrel.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
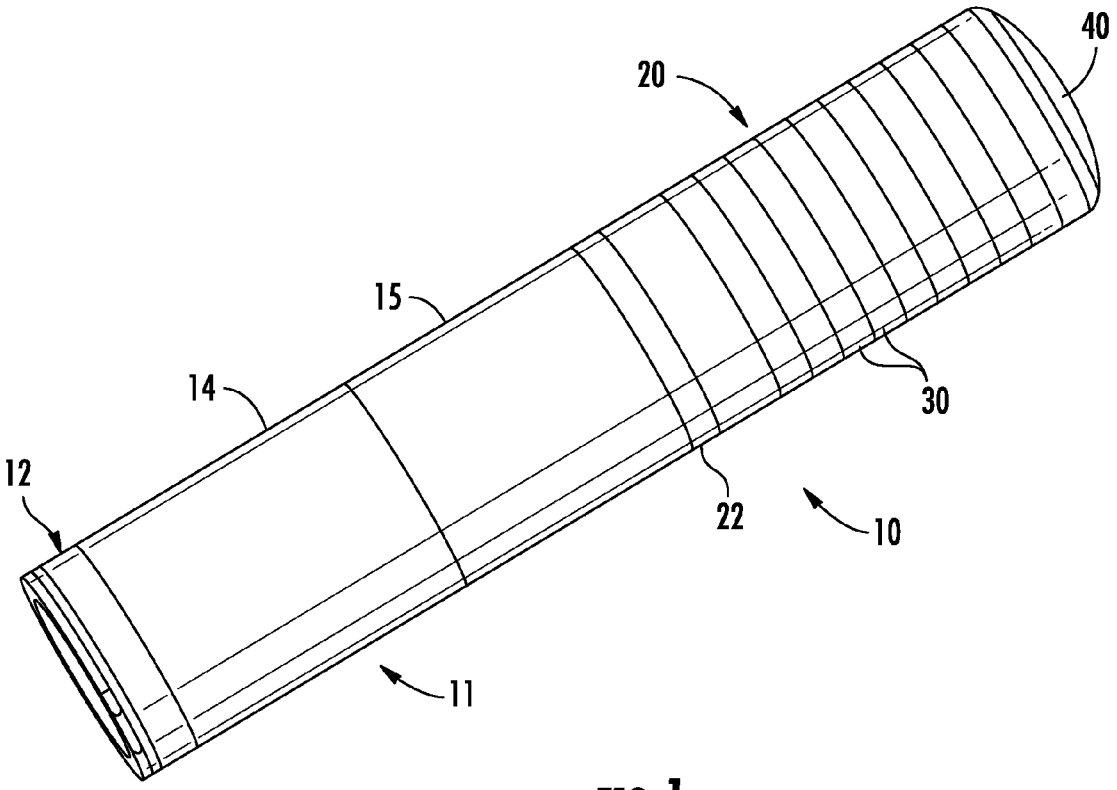
FIG. 1 is a perspective view illustrating a suppressor according to the present invention.
Figure 2:
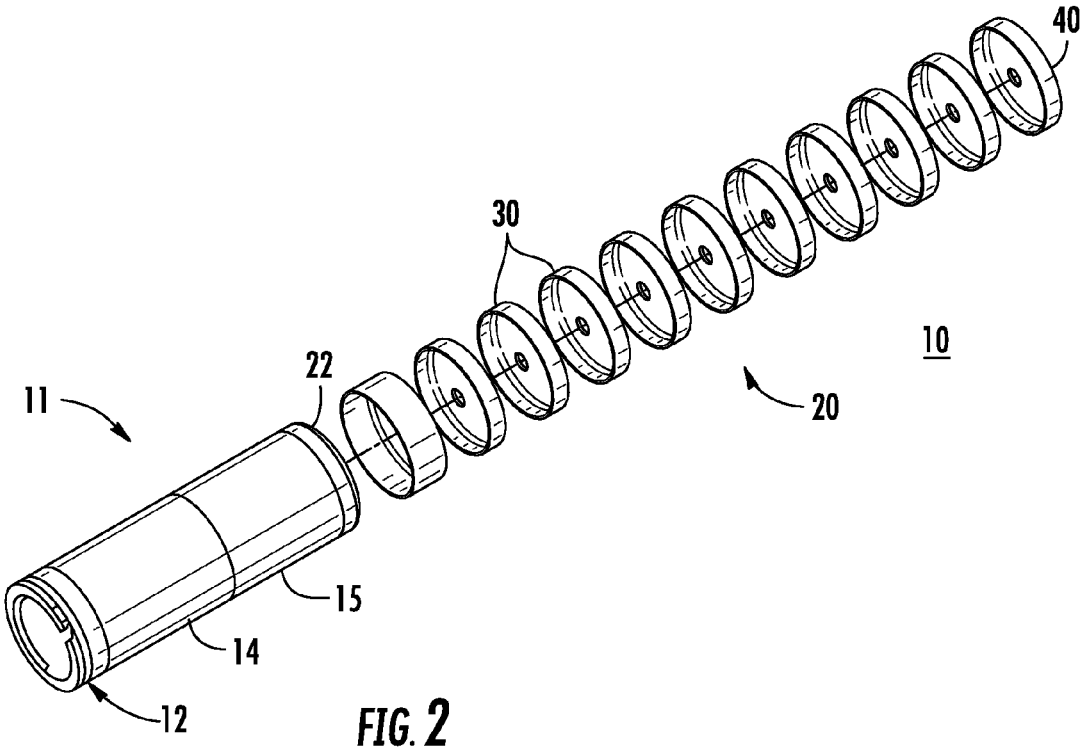
FIG. 2 is an exploded view of the suppressor of FIG. 1.

Turning now to the drawings in which like reference characters indicate corresponding elements throughout the several views, attention is first directed to FIGS. 1 and 2, which illustrate a suppressor generally designated 10. For purposes of this description, the term rearward is a direction toward a firearm to which the suppressor is mounted, and the term forward is a direction away from the firearm. Suppressor 10 includes a rear mount assembly 12 configured to engage the barrel of a firearm proximate a muzzle thereof. A front mounting block 14 partially encloses rear mount assembly 12 and prevents gasses from escaping therearound. A blast shield 15 abuts front mounting block 14 and forms a blast chamber at the muzzle of the firearm. In this preferred embodiment rear mount assembly 12, front mounting block 14, and blast shield 15 are included in mounting apparatus, generally designated 11, but may in some specific applications differ in shape and number from the specific elements illustrated and described. A baffle module 20 is positioned forward of and abutting blast shield 15 or any element of mounting apparatus 11 provided for that purpose.

Figure 3:
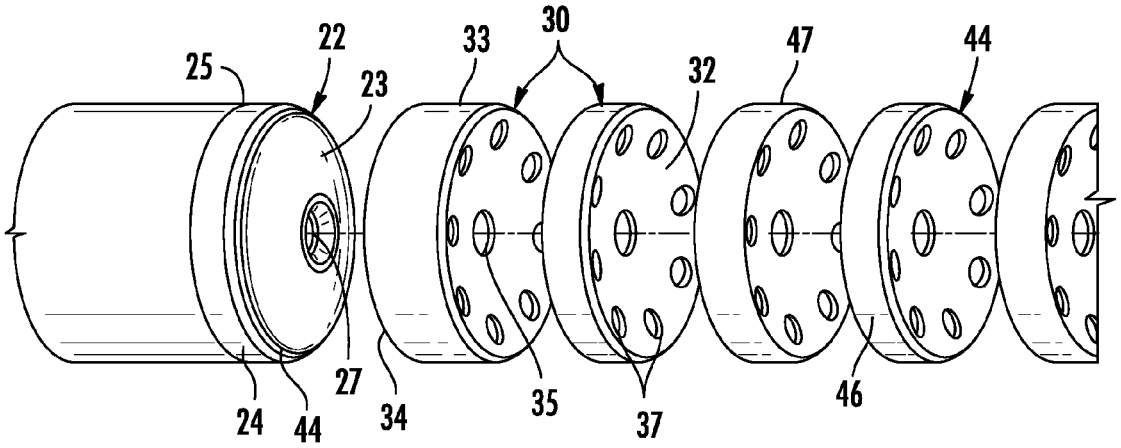
FIG. 3 is an enlarged exploded perspective view of a modular baffle assembly from a forward perspective.
Figure 4:
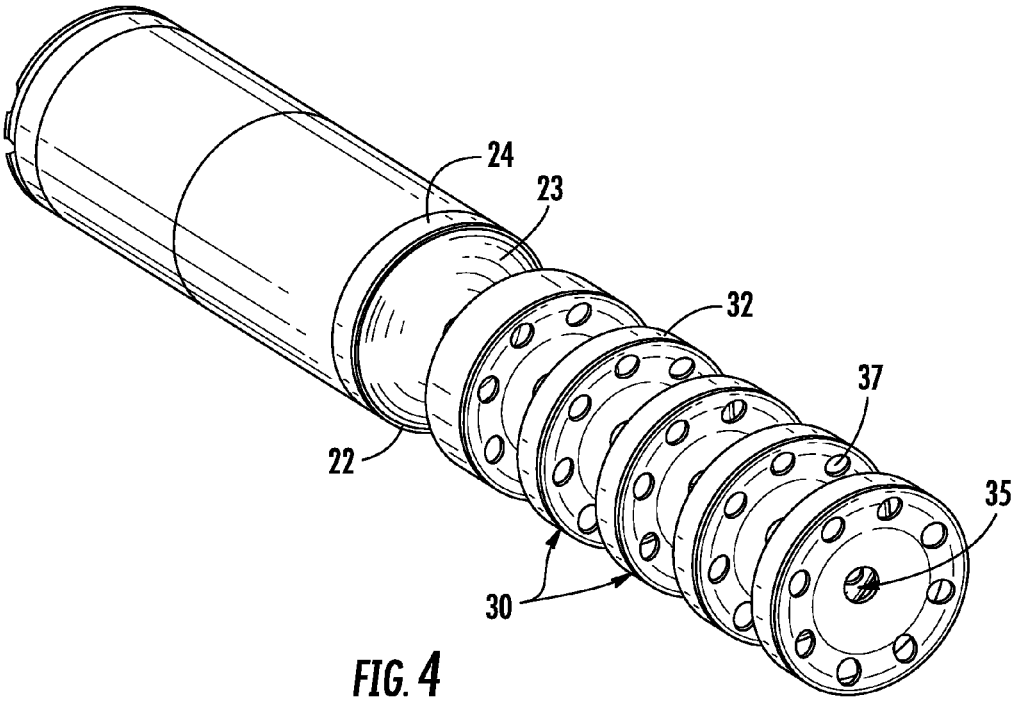
FIG. 4 is an exploded perspective view of the suppressor of FIG. 1 from a forward perspective.

With additional reference to FIGS. 3 and 4, baffle module 20 includes a blast cap 22 having a convex plate 23 (as viewed from the front end) with a parametric edge. A sidewall 24 extends generally perpendicularly from the parametric edge of convex plate 23 and terminates in an end 25. Blast cap 22 includes a central aperture 27 defined by and extending centrally through convex plate 23. Central aperture 27 is positioned and sized to permit passage of a projectile fired from a firearm, therethrough. Blast cap 22 further includes an aligning feature which will be described presently.

Still referring to FIGS. 2, 3 and 4, baffle module 20 further includes a plurality of baffles 30. Each of baffles 30 includes a concave plate 32 (as viewed from the front end) with a parametric edge. A cylindrically shaped sidewall 33 extends generally perpendicularly from the parametric edge of concave plate 32 and terminates in an end 34. Each of baffles 30 also include a central aperture 35 defined by and extending centrally through concave plate 32. Central aperture 35 is positioned and sized to permit passage of a projectile fired from a firearm, therethrough. A plurality of gas ports 37 are defined by and formed through concave plate 32, spaced about and intermediate central aperture 35 and the parametric edge. Gas ports 37 permit blast gasses from the firearm discharge to pass between baffles and thereby attenuate the energy thereof. While more or less gas ports 37 can be supplied as desired, in the preferred embodiment, eight gas ports 37 are provided, equally spaced apart at approximately 45 degrees from adjacent ports. When stacked, as will be described presently, each baffle 30 is preferably rotated approximately 22.5 degrees from adjacent baffles 30. This misaligns gas ports 37, preventing direct discharge of gasses, requiring deflection and redirection of the gasses to facilitate dissipation thereof through baffle module 20. Module 20 is terminated by an end cap 40. End cap 40 is substantially identical to blast cap 22, and, when multiple modules are employed, will be considered the blast cap of the subsequent module. Each of the elements in cooperation includes aligning and joining features.

Figure 5:
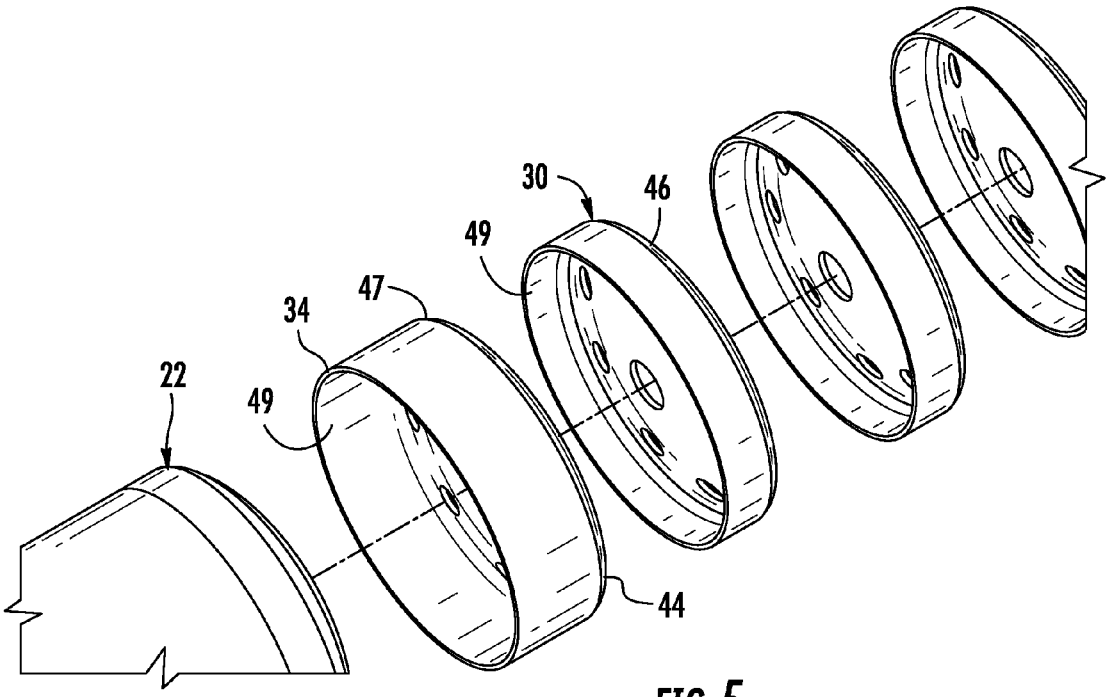
FIG. 5 is an enlarged exploded perspective view of a modular baffle assembly from a rearward perspective.
Figure 6:
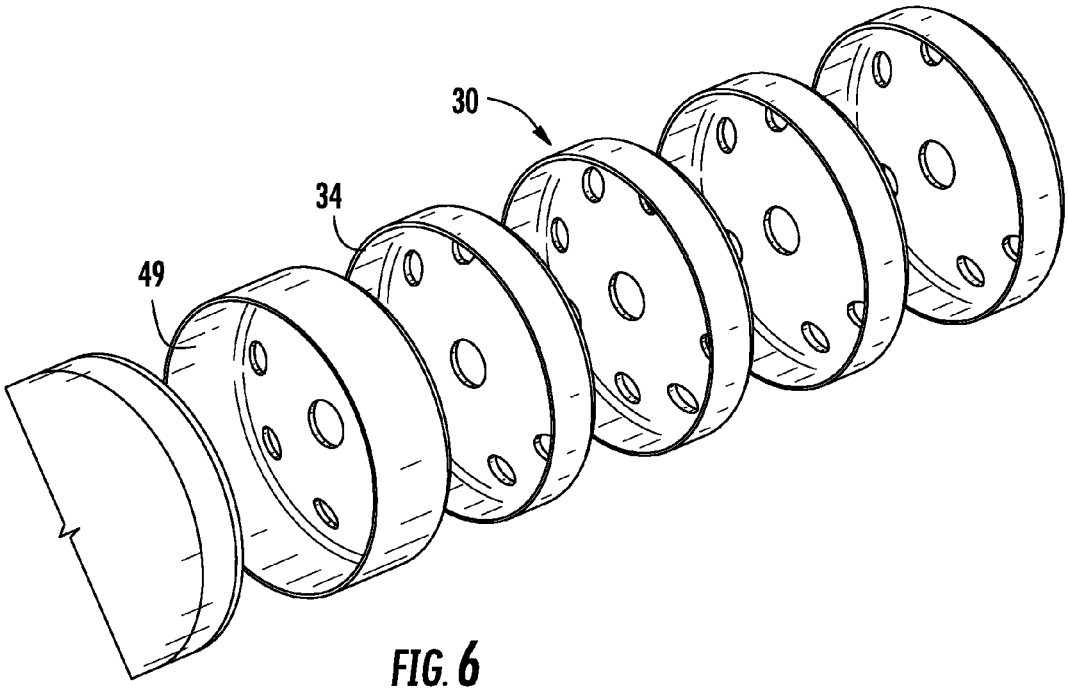
FIG. 6 is an enlarged exploded perspective view of portions of the modular baffle assembly from a rearward perspective illustrating internal details.

The aligning and joining features of the elements previously described are all substantially identical. Therefore, only one will be described in detail. Rear mount assembly 12, front mounting block 14, blast shield 15, blast cap 22, baffles 30 and end cap 40, the "elements", each include the aligning and joining features in conjunction with adjacent elements. With additional reference to FIGS. 5 and 6, the aligning and joining features will be described with respect to aligning and joining the elements including baffles 30. The aligning and joining features include a shoulder 44 formed at the junction of the parametric edge of convex plates 32 and sidewalls 33 for each of baffles 30 and a similar shoulder formed in each of the other elements. Shoulder 44 is a step radially outwardly from and rearward of concave plate 32. Shoulder 44 is defined by a male centering surface 46 extending substantially perpendicularly to plate 32 and a stacking surface 47 substantially perpendicular to and extending radially outwardly from male centering surface 46. A female centering surface 49 is an inner surface of sidewalls 33, and abuts male centering surface 46 of adjacent elements. For example, when adjacent baffles 30 are stacked, the end 34 of a baffle 30 abuts stacking surface 47 of the adjacent baffle 30. The aligning and joining features align central aperture 35 of each element to provide an unobstructed passageway for a fired projectile. Once positioned and aligned, each element is fixed to an adjacent element by the use of adhesives, welds and the like. For example, in the preferred embodiment the end 34 of a baffle element 30 is welded 360 degrees to the abutting stacking surface 47.

Figure 7:
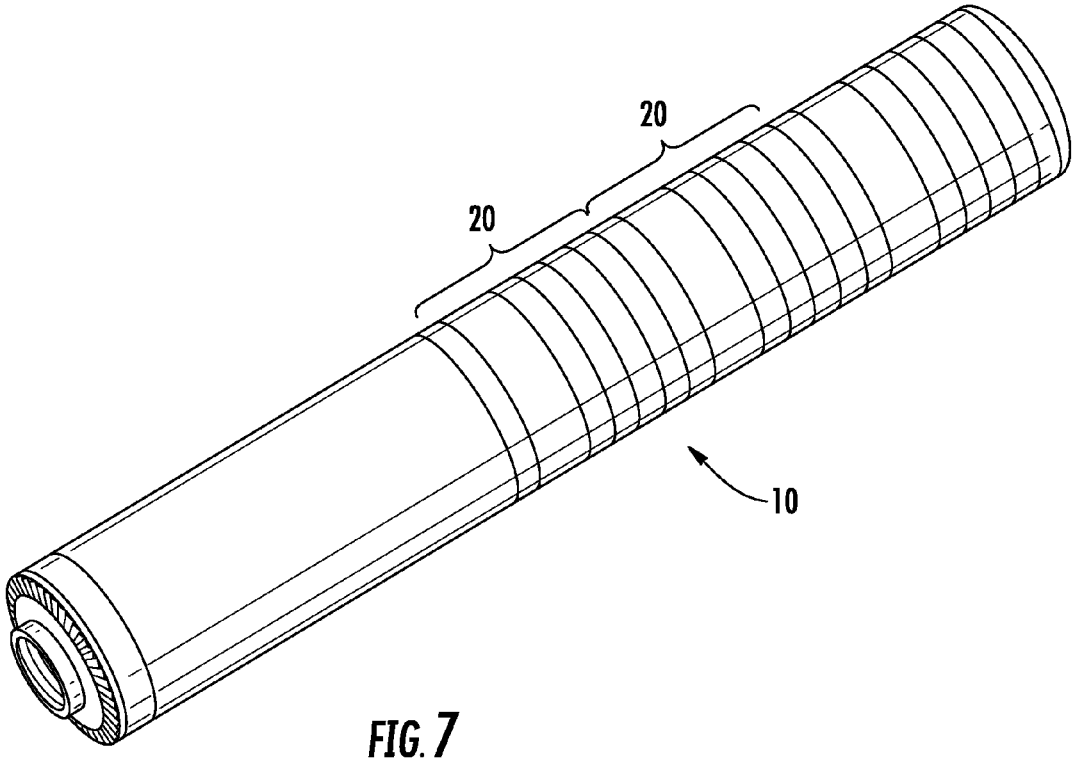
FIG. 7 is a perspective view of an assembled suppressor with multiple modular chambers according to the present invention.

Turning now to FIG. 7, it can be seen that multiple modules 20 can be stacked to increase the muzzle blast dissipation for greater muzzle blasts. Additionally each module can include more or less baffles 30. In this manner, a suppressor 10 can be fabricated for firearms having different muzzle blasts by increasing/decreasing modules, and/or increasing/decreasing baffles in each module. It will be noted that in this embodiment the first baffle 30 aligned and joined with blast cap 22 has a slightly longer sidewall 33 to compensate or space the convex plate 23 of blast cap 22 from the concave plate of the first baffle 30. Similarly, the first baffle in each additional module of multiple modules is formed with a slightly longer sidewall to compensate or space the convex plate of the end cap from the concave plate of the first baffle.

Figure 8:
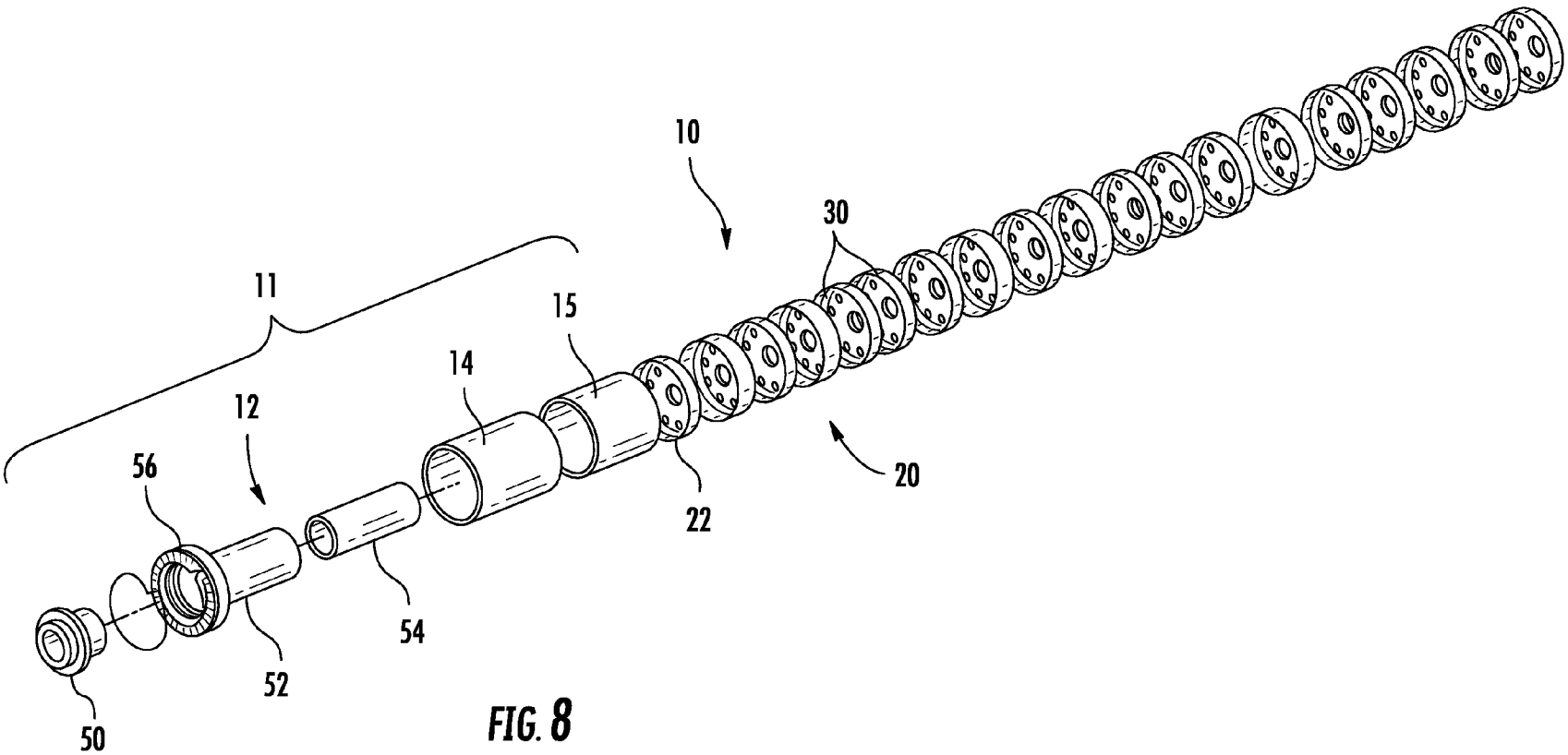
FIG. 8 is an exploded view of the suppressor of FIG. 7.

Referring now to FIG. 8, rear mount assembly 12 receives a barrel therethrough and acts to stabilize and seal suppressor 10 with respect to the barrel. A barrel fixture 50 having a threaded outer surface is fixed to a barrel rearward of the muzzle end. A base member 52 slides over the barrel and a muzzle break 54 to threadably engage barrel fixture 50. Base member 52 has an enlarged rearward end 56 which receives front mounting block 14 using the alignment and joining feature as described previously. Mounting block 14 seals to enlarged end 56 to prevent any blast escaping, and directing the blast forwardly.

It will be appreciated that suppressors 10 can be manufactured and assembled for virtually any firearm with central aperture 35 being formed to match any specific caliber and the number of baffle modules 20 and number of baffles 30 in each module being selected to provide a desired amount of muzzle blast reduction or suppression. Thus, a new and improved suppressor for reducing the muzzle blast in a firearm has been disclosed. The new and improved suppressor can be relatively easily manufactured and conveniently produced for and mounted on virtually any firearm. Specifically, the new and improved suppressor can be modified to suppress muzzle blasts for a variety of different muzzle blast intensities and for virtually any caliber of firearm.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A suppressor for reducing muzzle blasts in firearms comprising:

a mounting apparatus with a rear end designed to mate with a firearm barrel and a front end;

a blast baffle having a rear end and a front end and defining a central aperture extending therethrough, the blast baffle including in conjunction with the mounting apparatus aligning and joining features mating the rear end of the blast baffle with the front end of the mounting apparatus;

a plurality of baffles with each baffle having a rear end and a front end and defining a central aperture extending therethrough, each baffle further including aligning and joining features in conjunction with one of an adjacent baffle and the blast baffle mating the rear end of the baffle with the front end of the one of the adjacent baffle and the blast baffle, each baffle including a plate defining the front end, the plate having a parametric edge and a cylindrically shaped sidewall extending rearwardly from the parametric edge of the plate and terminating in the rear end, the plate being entirely forward of the rear end without any portion extending rearwardly to a radial plane defined by the rear end, a forward portion of the aligning and joining feature being a shoulder formed in the sidewall, adjacent the parametric edge, the plate of each baffle having a plurality of gas ports defined therethrough the gas ports being spaced about the central aperture and positioned intermediate the central aperture and an outer edge of the plate;

an end cap having a rear end and a front end and defining a central aperture extending therethrough, the end cap including in conjunction with a baffle adjacent the end cap aligning and joining features mating the rear end of the end cap with the front end of the baffle adjacent the end cap; and the mounting apparatus, the blast baffle, the plurality of baffles, and the end cap affixed together, using the aligning and joining features of each, to form the suppressor without an outer shell and with the central apertures longitudinally aligned with the firearm barrel.

2. A suppressor as claimed in claim 1 wherein each plate of the plurality of baffles includes a concave plate with the parametric edge defining the front end and the cylindrically shaped sidewall extending rearwardly generally perpendicularly from the parametric edge of the concave plate and terminating in the rear end.

3. A suppressor as claimed in claim 2 wherein each baffle of the plurality of baffles includes at least eight gas ports defined therethrough.

4. A suppressor as claimed in claim 3 wherein each baffle of the plurality of baffles is rotated approximately 22.5 degrees from adjacent baffles in the suppressor.

5. A suppressor as claimed in claim 2 wherein each baffle of the plurality of baffles includes eight gas ports spaced approximately 45 degrees apart about the central aperture.

6. A suppressor as claimed in claim 2 wherein the concave plate of each baffle of the plurality of baffles is concave as viewed from the front end of the baffle.

7. A suppressor as claimed in claim 1 wherein the blast baffle includes a convex plate with a parametric edge defining the front end, a cylindrical sidewall extends generally perpendicularly rearwardly from the parametric edge of the convex plate and terminates in the rear end.

8. A suppressor as claimed in claim 1 wherein the end cap includes a convex plate with a parametric edge defining the front end, a cylindrical sidewall extends generally perpendicularly from the parametric edge of the convex plate and terminates in the rear end.

9. A suppressor as claimed in claim 1 wherein the mounting apparatus includes a rear mount assembly configured to engage the barrel of a firearm proximate a muzzle thereof, a front mounting block partially enclosing the rear mount assembly to prevent gasses from escaping therearound, and a blast shield abutting the front mounting block and forming a blast chamber at the muzzle of the firearm barrel.

10. A suppressor as claimed in claim 9 wherein the rear mount assembly includes a barrel fixture having a threaded outer surface fixed to the firearm barrel rearward of the muzzle end a base member slideably engaged over the firearm barrel, and a muzzle break threadably engaged with the barrel fixture, the base member including an enlarged rearward end and receiving the front mounting block using alignment and joining features in conjunction with the rear end of the front mounting block.

11. A suppressor for reducing muzzle blasts in firearms comprising:

a mounting apparatus with a rear end designed to mate with a firearm barrel and a front end;

a blast baffle including a convex plate with a parametric edge defining a front end and a cylindrical sidewall extending generally perpendicularly from the parametric edge of the convex plate and terminating in a rear end, the blast baffle defining a central aperture extending through the convex plate, the blast baffle including in conjunction with the mounting apparatus aligning and joining features mating the rear end of the blast baffle with the front end of the mounting apparatus;

a plurality of baffles each baffle of the plurality of baffles including a concave plate with a parametric edge defining a front end and a cylindrically shaped sidewall extending rearwardly generally perpendicularly from the parametric edge of the concave plate and terminating in a rear end, and each baffle of the plurality of baffles defining a central aperture extending through the concave plate, the concave plate being entirely forward of the rear end without any portion extending rearwardly to a radial plane defined by the rear end, each baffle of the plurality of baffles further including aligning and joining features in conjunction with one of an adjacent baffle and the blast baffle mating the rear end of the baffle with the front end of the one of the adjacent baffle and the blast baffle, a forward portion of the aligning and joining feature being a shoulder formed in the sidewall, adjacent the parametric edge, the concave plate of each baffle having a plurality of gas ports defined therethrough the gas ports being spaced about the central aperture and positioned intermediate the central aperture and an outer edge of the plate;

an end cap including a convex plate with a parametric edge defining a front end and a cylindrical sidewall extending generally perpendicularly from the parametric edge of the convex plate and terminating in a rear end, the end cap defining a central aperture extending through the convex plate, the end cap including in conjunction with a baffle adjacent the end cap aligning and joining features mating the rear end of the end cap with the front end of the baffle adjacent the end cap; and the mounting apparatus, the blast baffle, the plurality of baffles, and the end cap affixed together, using the aligning and joining features of each, to form the suppressor without an outer shell and with the central apertures longitudinally aligned.

12. A suppressor as claimed in claim 11 wherein each baffle of the plurality of baffles includes at least eight gas ports defined therethrough.

13. A suppressor as claimed in claim 12 wherein each baffle of the plurality of baffles is rotated approximately 22.5 degrees from adjacent baffles in the suppressor.

14. A suppressor as claimed in claim 11 wherein each baffle of the plurality of baffles includes eight gas ports spaced approximately 45 degrees apart about the central aperture.

15. A suppressor as claimed in claim 11 wherein the mounting apparatus includes a rear mount assembly configured to engage the barrel of a firearm proximate a muzzle thereof, a front mounting block partially enclosing the rear mount assembly to prevent gasses from escaping therearound, and a blast shield abutting the front mounting block and forming a blast chamber at the muzzle of the firearm barrel.

16. A suppressor as claimed in claim 15 wherein the rear mount assembly includes a barrel fixture having a threaded outer surface fixed to the firearm barrel rearward of the muzzle end a base member slideably engaged over the firearm barrel, and a muzzle break threadably engaged with the barrel fixture, the base member including an enlarged rearward end and receiving the front mounting block using alignment and joining features in conjunction with the rear end of the front mounting block.

17. A suppressor for reducing muzzle blasts in firearms comprising:

a mounting apparatus including a rear mount assembly configured to engage the barrel of a firearm proximate a muzzle thereof, a front mounting block partially enclosing the rear mount assembly to prevent gasses from escaping therearound, and a blast shield abutting the front mounting block and forming a blast chamber at the muzzle of the firearm barrel;

a blast baffle including a convex plate with a parametric edge defining a front end and a cylindrical sidewall extending generally perpendicularly from the parametric edge of the convex plate and terminating in a rear end, the blast baffle defining a central aperture extending through the convex plate, the blast baffle including in conjunction with the mounting apparatus aligning and joining features mating the rear end of the blast baffle with the front end of the mounting apparatus;

a plurality of baffles each baffle of the plurality of baffles including a concave plate with a parametric edge defining a front end and a cylindrically shaped sidewall extending rearwardly generally perpendicularly from the parametric edge of the concave plate and terminating in a rear end, and each baffle of the plurality of baffles defining a central aperture extending through the concave plate, the plate being entirely forward of the rear end without any portion extending rearwardly to a radial plane defined by the rear end, each baffle of the plurality of baffles further including aligning and joining features in conjunction with one of an adjacent baffle and the blast baffle mating the rear end of the baffle with the front end of the one of the adjacent baffle and the blast baffle, a forward portion of the aligning and joining feature being a shoulder formed in the sidewall at the front end, the concave plate of each baffle having a plurality of gas ports defined therethrough the gas ports being spaced about the central aperture and positioned intermediate the central aperture and an outer edge of the plate;

an end cap including a convex plate with a parametric edge defining a front end and a cylindrical sidewall extending generally perpendicularly from the parametric edge of the convex plate and terminating in a rear end, the end cap defining a central aperture extending through the convex plate, the end cap including in conjunction with a baffle adjacent the end cap aligning and joining features mating the rear end of the end cap with the front end of the baffle adjacent the end cap; and the mounting apparatus, the blast baffle, the plurality of baffles, and the end cap affixed together, using the aligning and joining features of each, to form the suppressor without an outer shell and with the central apertures longitudinally aligned.

18. A suppressor as claimed in claim 17 wherein the rear mount assembly includes a barrel fixture having a threaded outer surface fixed to the firearm barrel rearward of the muzzle end a base member slideably engaged over the firearm barrel, and a muzzle break threadably engaged with the barrel fixture, the base member including an enlarged rearward end and receiving the front mounting block using alignment and joining features in conjunction with the rear end of the front mounting block.

19. A suppressor as claimed in claim 17 wherein each baffle of the plurality of baffles includes eight gas ports spaced approximately 45 degrees apart about the central aperture.

20. A suppressor as claimed in claim 19 wherein each baffle of the plurality of baffles is rotated approximately 22.5 degrees from adjacent baffles in the suppressor.

* * * * *